US011276331B1

(12) United States Patent
Kaye et al.

(10) Patent No.: US 11,276,331 B1
(45) Date of Patent: Mar. 15, 2022

(54) FLEXIBLE PLACARD HOLDER

(71) Applicant: J.J. Keller & Associates, Inc., Neenah, WI (US)

(72) Inventors: Alex Julian Kaye, Fond du Lac, WI (US); Pamela Ann Kopelke, Greenville, WI (US)

(73) Assignee: J.J. Keller & Associates, Inc., Neenah, WI (US)

( * ) Notice: Subject to any disclaimer, the term of this patent is extended or adjusted under 35 U.S.C. 154(b) by 0 days.

(21) Appl. No.: 17/097,222

(22) Filed: Nov. 13, 2020

(51) Int. Cl.
*G09F 7/02* (2006.01)
*G09F 7/10* (2006.01)

(52) U.S. Cl.
CPC ..... *G09F 7/02* (2013.01); *G09F 7/10* (2013.01)

(58) Field of Classification Search
CPC ..... G09F 7/02; G09F 7/10; G09F 2007/1843; G09F 2007/1847; G09F 2007/1865
See application file for complete search history.

(56) References Cited

U.S. PATENT DOCUMENTS

| | | | | |
|---|---|---|---|---|
| 1,583,740 | A * | 5/1926 | Palmer | B61K 13/04 40/653 |
| 3,174,239 | A * | 3/1965 | Cramer | G09F 7/10 40/650 |
| 3,518,782 | A | 7/1970 | Long | |
| 4,058,918 | A | 11/1977 | Fund | |
| 4,094,083 | A | 6/1978 | Fund | |
| 4,106,229 | A * | 8/1978 | Schmid | G09F 7/00 40/588 |
| 4,229,891 | A * | 10/1980 | Keller | G09F 7/00 40/590 |
| 4,715,138 | A | 12/1987 | Cherico | |
| 4,955,153 | A * | 9/1990 | Albrecht | G09F 3/18 40/490 |
| 6,067,011 | A | 5/2000 | Leslie | |
| 6,665,967 | B1 | 12/2003 | Quackenbush | |
| 6,785,993 | B1 | 9/2004 | Lea | |
| D534,219 | S | 12/2006 | Seljeseth et al. | |
| 7,707,759 | B2 | 5/2010 | Roberts | |
| D655,348 | S * | 3/2012 | Cooper | D20/43 |
| 8,910,403 | B2 * | 12/2014 | Nimtz | G09F 13/00 40/590 |
| 2010/0077641 | A1 * | 4/2010 | Greenwald | G09F 7/08 40/611.11 |
| 2017/0193883 | A1 | 7/2017 | Pal | |
| 2018/0374397 | A1 * | 12/2018 | Kopelke | G09F 21/04 |

* cited by examiner

*Primary Examiner* — Gary C Hoge
(74) *Attorney, Agent, or Firm* — Boyle Fredrickson, SC

(57) ABSTRACT

The present invention relates generally to a placard holder and, more specifically, to a placard holder capable of being mounted to a curved surface.

16 Claims, 13 Drawing Sheets

FLEXIBLE PLACARD HOLDER

BACKGROUND

Traditional placard holders are rigid and do not bend over curved surfaces such as tanker trailer sides or tank conical/convex end caps. Because of this rigidity, trailer manufacturers commonly fabricate a separate bracket to attach the flat placard holder to a curved surface. This adds manufacturing cost and weight to the trailer. In some situations when manufacturers have no other option, they have simply attempted to bend the placard onto a curved surfaces. This generates additional friction and difficulty in removing the placard which causes customer frustration.

Traditional placard holders often are fabricated of two pieces of stamped aluminum riveted together with a shield and a placard inserted therebetween. The front facing panel features a stamped angled offset around its perimeter which serves as the frame to keep the placard and shield in place. The front panel is riveted to a back pane which creates a pinch point between the two panels and which frequently causes the placard and the shield to become wedged into the frame. This jamming makes it very difficult to unwedge and slide the placard and shield in and out. The stamped design increases its stiffness and prevents it from bending. Bending the traditional holder slightly causes the placard holder to kink, making it unusable to slide a placard into the holder.

Traditional placard holders often utilize a two-piece clip mounted at the top of the back panel. The clip must be manually flipped open to install a placard and then manually closed to keep the shield and the placard within the frame in place. If the clip is accidently left in the open position, the shield and the placard are no longer secure. When this happens, there exists a risk of the placard being blown out of the holder which can result in non-compliance with regulations, safety issues, or mishandling of hazardous materials in the event of a spill or incident.

SUMMARY

One aspect of the invention includes a placard holder for displaying a placard comprising a flexible frame capable of being mounted to a curved surface without being damaged and capable of holding a placard.

Another aspect of the invention includes a placard holder for displaying a placard comprising a flexible frame capable of being mounted to a curved surface without being damaged and capable of holding a placard and a one-piece clip biased in a closed position for holding the placard in the frame.

Another aspect of the invention include a placard holder for displaying a placard comprising a flexible frame capable of being mounted to a curved surface without being damaged and capable of holding a placard, the frame defined by a top portion, a bottom portion, two side portions and at least one cross brace extending between the bottom portion and one of the side walls, a spacer secured to the frame defining a channel for holding the placard and a one-piece clip biased in a closed position for holding the placard in the frame.

Other aspects of the invention will become apparent by consideration of the detailed description and accompanying drawings.

Figure 1:
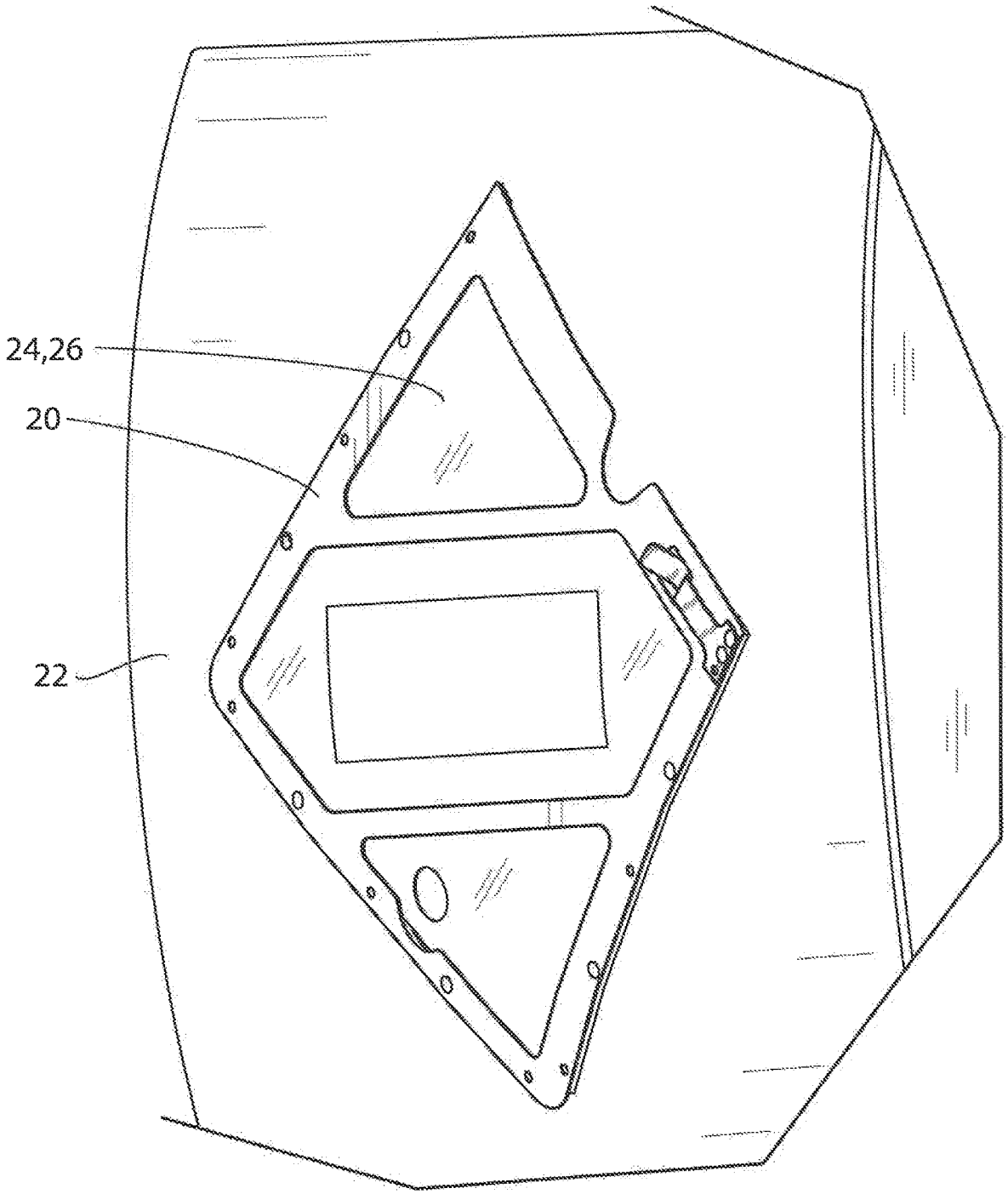
FIG. 1 is a perspective view of a flexible placard holder installed on a curved surface.

Before any embodiments of the invention are explained in detail, it is to be understood that the invention is not limited in its application to the details of constructions and the arrangement of components set forth in the following description or illustrated in the drawings. The invention is capable of other embodiments and of being practiced or of being carried out in various ways.

DETAILED DESCRIPTION

With reference to FIG. 1, a flexible placard holder 20 is shown mounted to a curved surface 22. The holder 20 can be mounted to most non-planar surfaces such as round tanker trailers, convex end caps, semi-elliptical tankers and storage tanks, for example. It should be noted the placard 20 is designed for non-planar surfaces but can also be utilized with flat surfaces. Installed in the placard holder 20 is a placard 24 and a plastic clear shield 26 protecting the placard from the environment.

Figure 2:
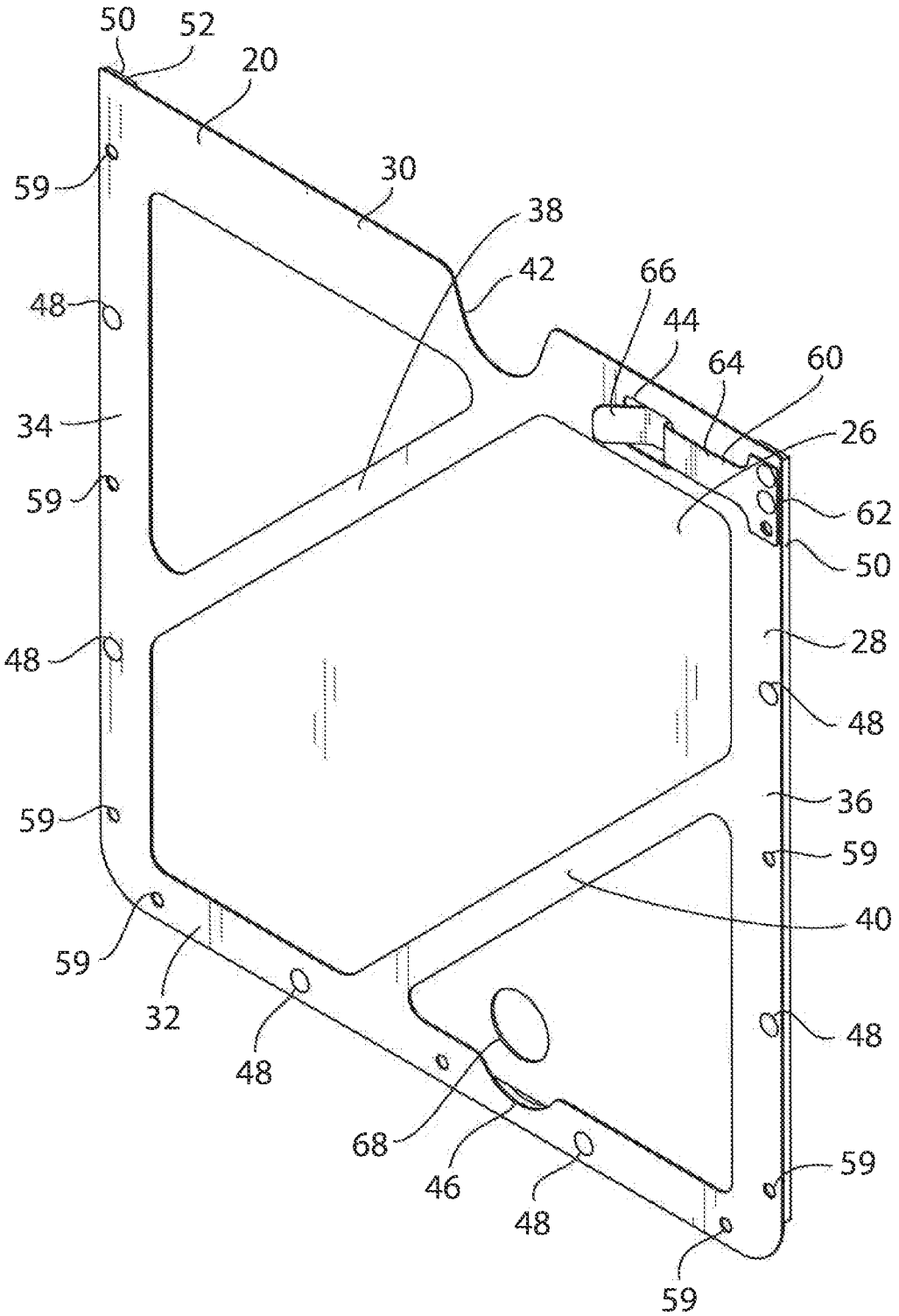
FIG. 2 is a perspective view of the flexible placard holder and a shield.
Figure 3:
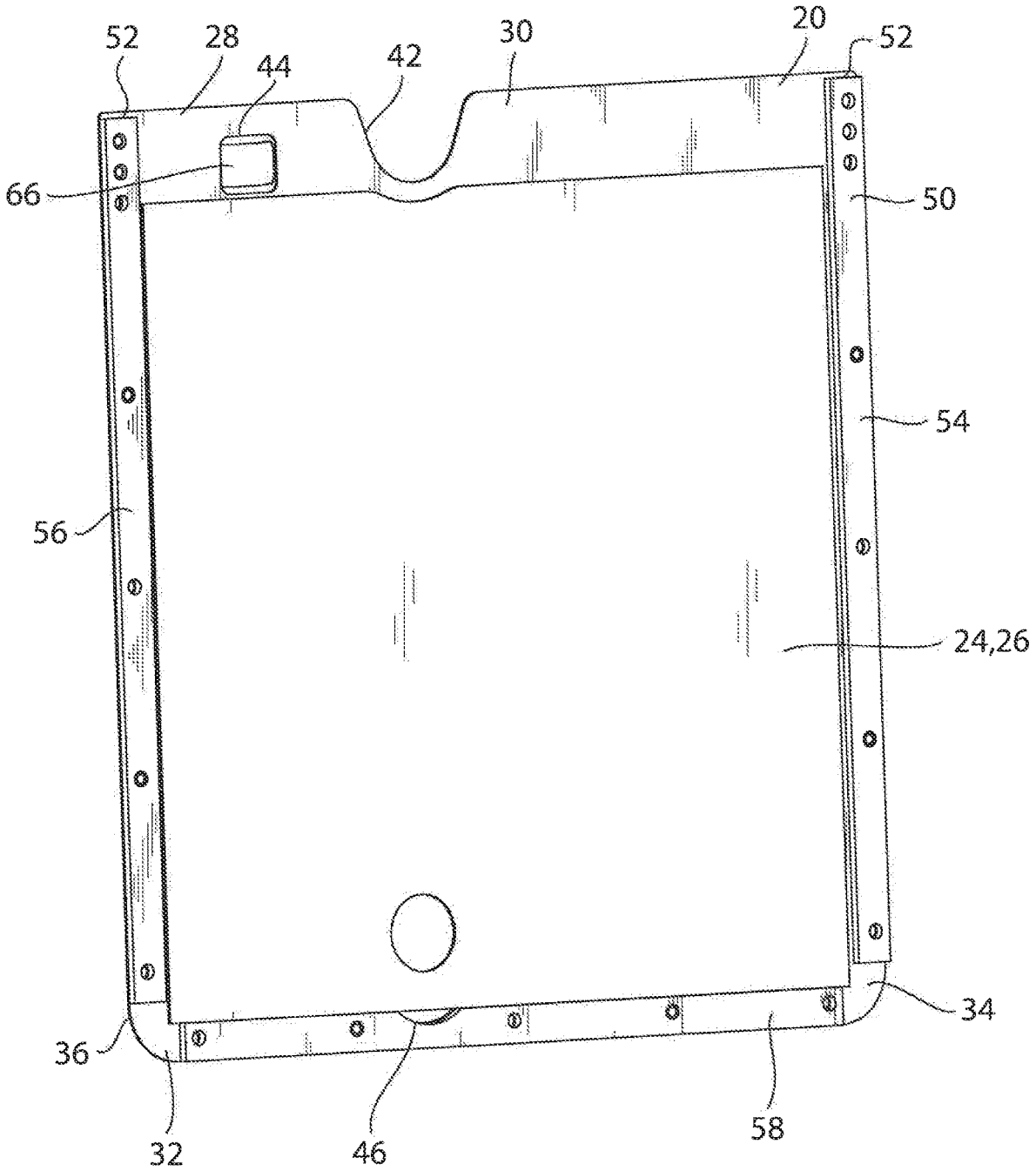
FIG. 3 is a rear view of the flexible placard holder and the shield.

As shown in FIGS. 2 and 3, the holder 20 is preferably fabricated from a single sheet of material, such as aluminum for example, however, other materials can be utilized. The holder 20 includes a frame 28 having a top portion 30, a bottom portion 32, two side portions 34 and 36 and two cross braces 38 and 40. The top portion 30 has a u-shaped cutout 42 and a clip aperture 44. The bottom portion 32 has a u-shaped cutout 46. The two side portions 34 and 36 and the bottom portion 32 include holes 48 adapted to receive fasteners to secure the holder 20 to the curved surface 22.

The holder 20 includes a spacer 50 to provide a channel 52 into which the placard 24 and the shield 26 can be placed and slidably move. As shown, the spacer 50 includes a first side spacer 54, a second side spacer 56 and a bottom spacer 58, however, it should be noted that the spacer 50 can be one piece or any number of pieces to form the channel 52. The spacers 54, 56 and 58 are preferably secured to the frame 28 with aluminum rivets 59, however, other methods or fasteners can also be utilized. The spacer 50 is preferably fabricated from a soft material such as plastic or aluminum, however, other materials can also be utilized.

The holder 20 includes one spring clip 60 for securing the placard 24 and the shield 26 in the holder 20. The clip 60 includes a base portion 62 mounted to the frame 28, an arm 64 and terminates in an angular end portion 66. The clip 60 is normally in a biased closed position such that the end portion 66 is in the aperture 44. To remove the end portion 66 of the clip 60 from the aperture 44, a user lifts up on the end portion 66 manually. When a user releases the end portion 66, the clip 60 returns to its closed position. As such, the user never has to manually move the clip 60 to the closed position.

The shield 26 is preferably fabricated from a clear plastic such as polycarbonate, acrylic or polyvinyl chloride, however, other materials can also be utilized. The shield 26 is preferably the same size as the placard 24. The shield 26 includes an aperture 68 such as the circular aperture shown in the figures, however, other geometries can also be utilized. In some applications, the shield 26 is not utilized and only the placard 24 is housed in the frame 28.

To mount the holder 20 to the curved surface 22, fasteners such as rivets or screws are utilized as is known in the art, however, other attachment methods can also be utilized.

Figure 4:
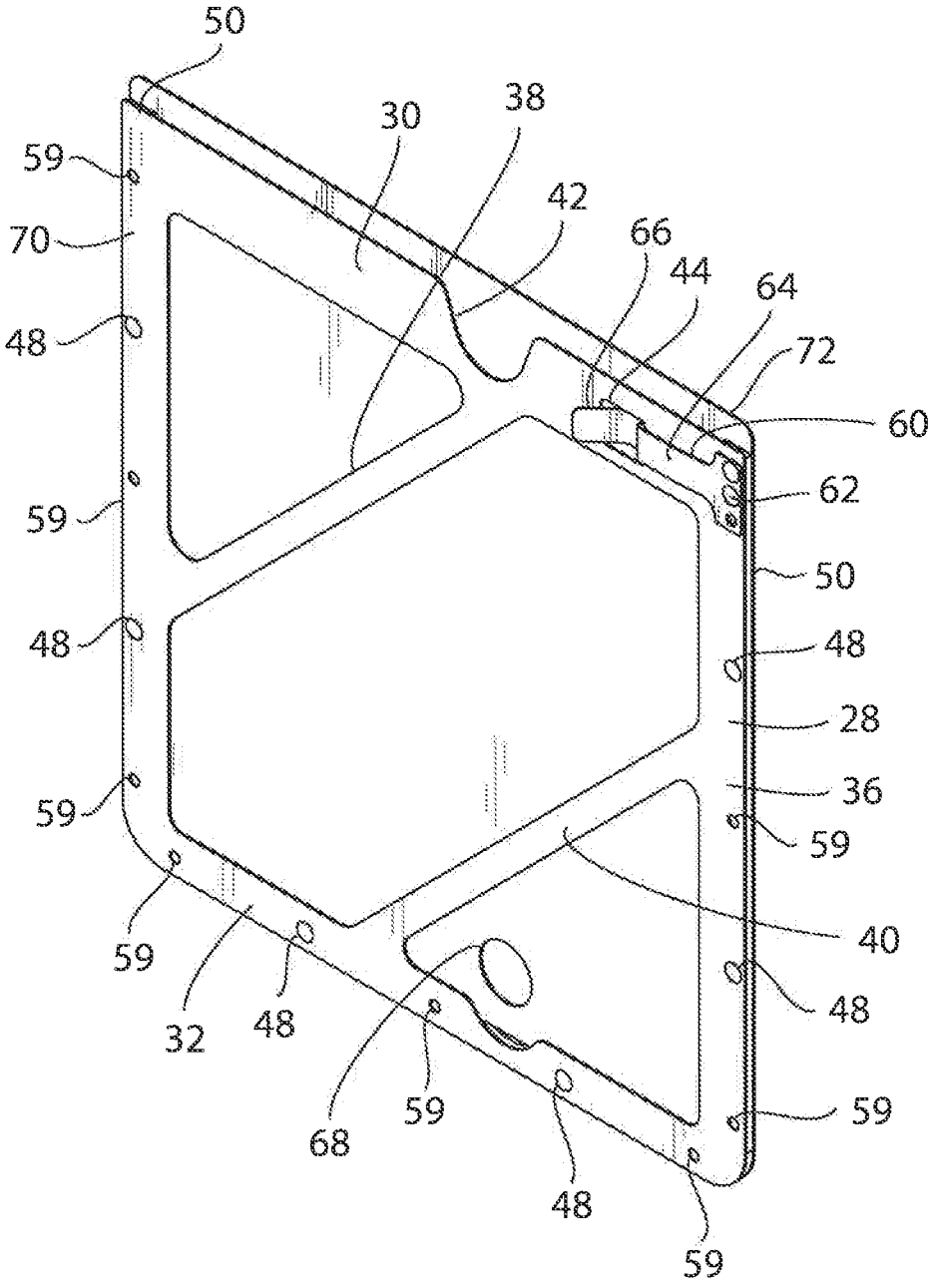
FIG. 4 is a perspective view of an alternate embodiment of a flexible placard holder and a shield.
Figure 5:
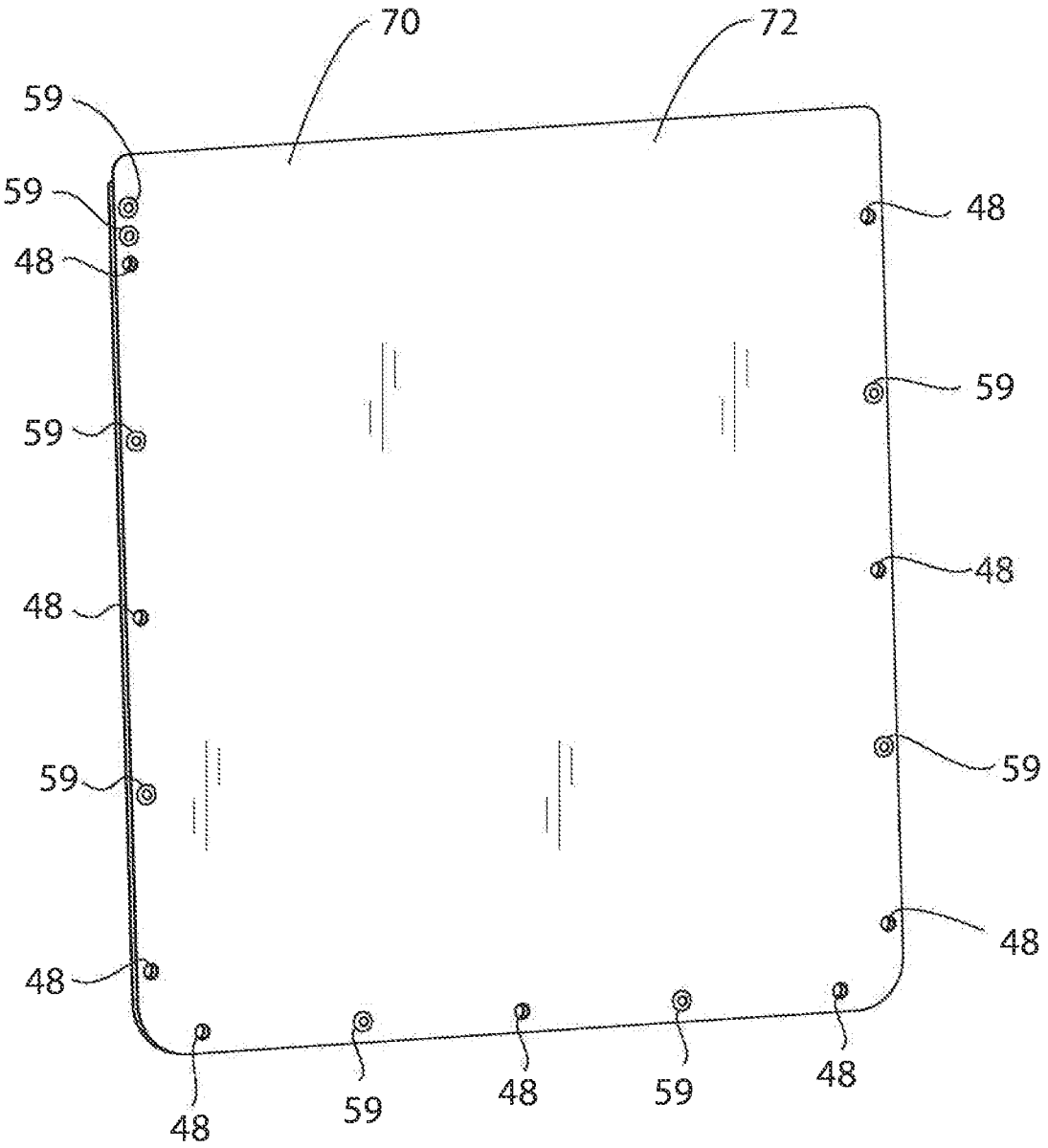
FIG. 5 is a rear view of the flexible placard holder of FIG. 4.

Turning now to FIGS. 4 and 5, an alternate embodiment is shown of flexible placard holder 70. The holder 70 is similar to that of holder 20 with like reference numerals being used for like components. The holder 70 further includes a back panel 72 preferably fabricated from aluminum, however, other materials can also be utilized. The back panel 72 is secured to the frame 28 with aluminum rivets, however, other fasteners and other materials can also be utilized.

Figure 6:
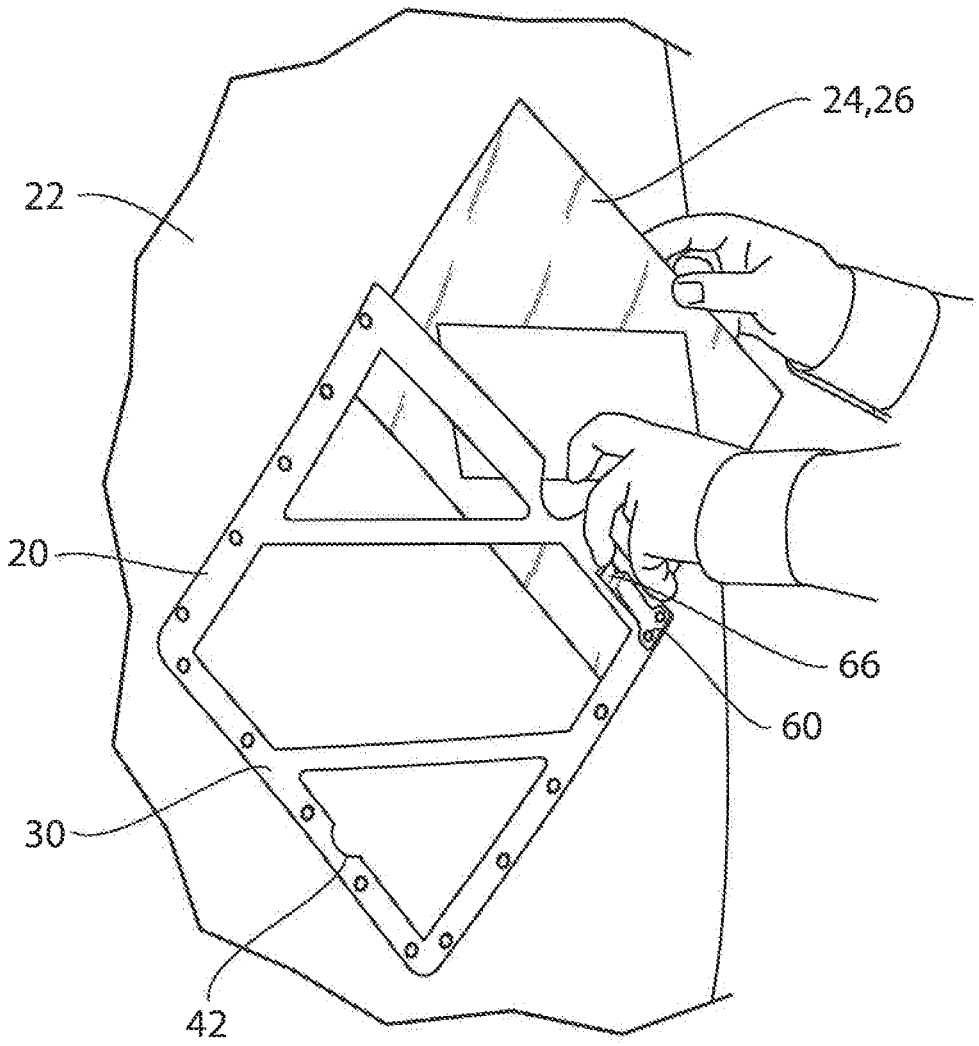
FIG. 6 is perspective view of a user installing a placard and a shield into the flexible placard holder.
Figure 7:
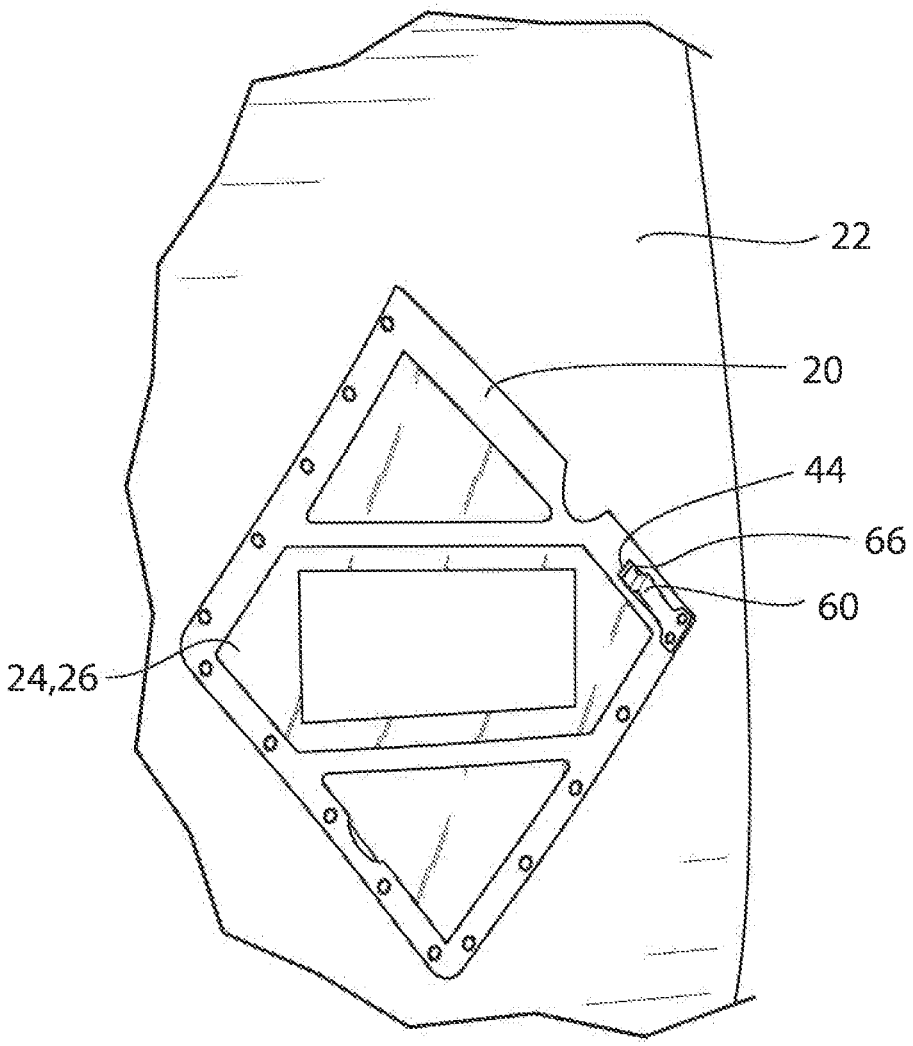
FIG. 7 is a view of a placard secured in the flexible placard holder.

With reference to FIGS. 6-9, installation and removal of the placard 24 and the shield 26 from the holder 20 is shown. In FIG. 6, the user pulls up on the end portion 66 of the clip 60. This allows access to the channel 52 so that the placard 24 and the shield 26 can slide in the channel 52. While continuing to pull up on the end portion 66 of the clip 60, the user pushes the placard 24 and the shield 26 until they stop in the bottom spacer 58 then the user releases the end portion 66 of the clip 60 as shown in FIGS. 7 and 3. The cutout 42 in the top portion 30 can be used by the user to push the placard 24 and the shield 26 into the proper position to make sure the placard 24 and the shield 26 are seated in the holder 20 and then the clip 60 can be released. The cutout 46 in the bottom portion 32 of the frame 28 provides a visual confirmation that the placard 24 and the shield 26 are seated properly in the holder 20. The placard 24 and the shield 26 are thereby secured in the holder 20 such that the end portion 66 of the clip 60 positioned in the aperture 44 blocks the placard 24 and the shield 26 from moving out of the holder 20.

Figure 8:
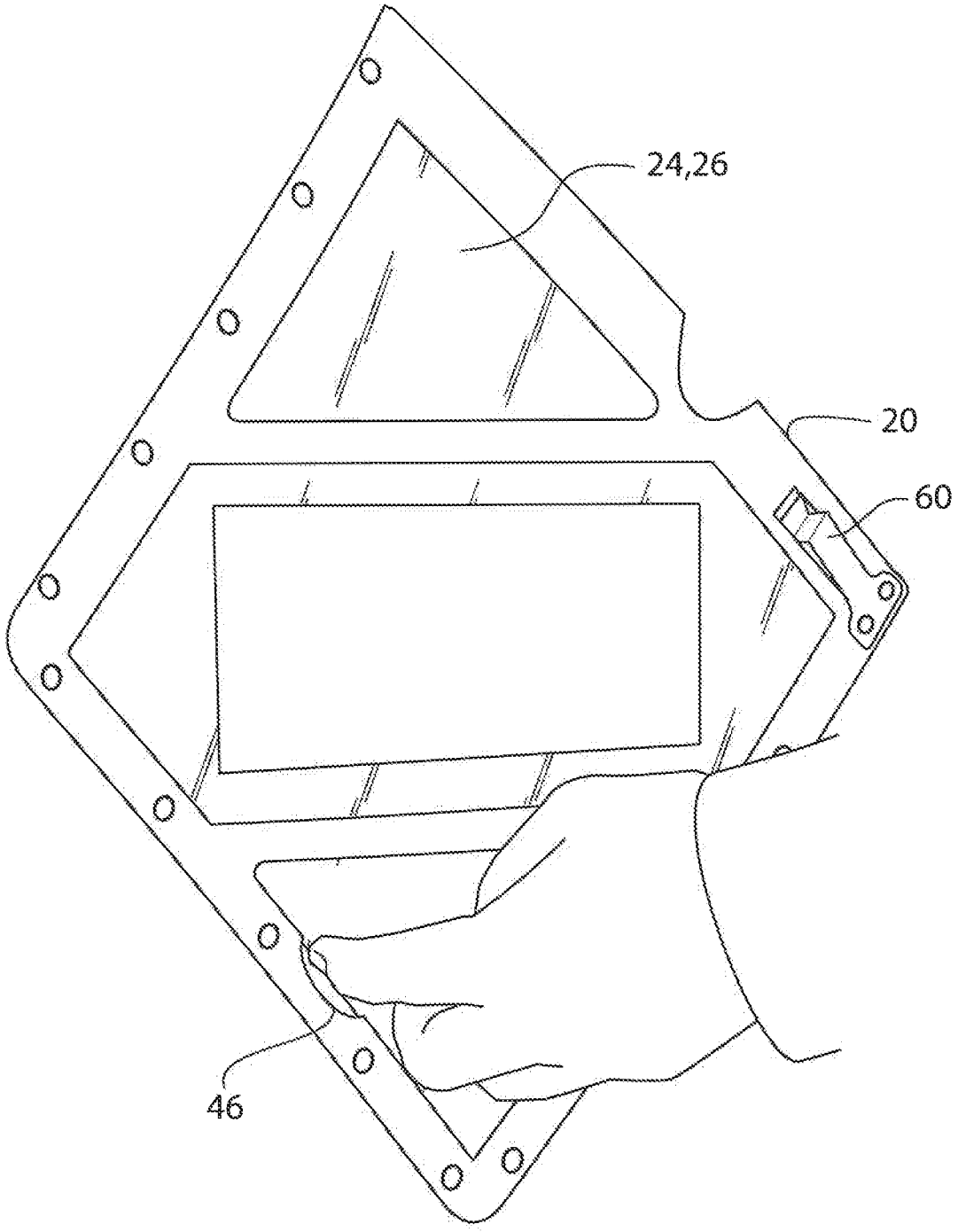
FIG. 8 is a view of a user starting the process of removing a placard and a shield from the flexible placard holder.
Figure 9:
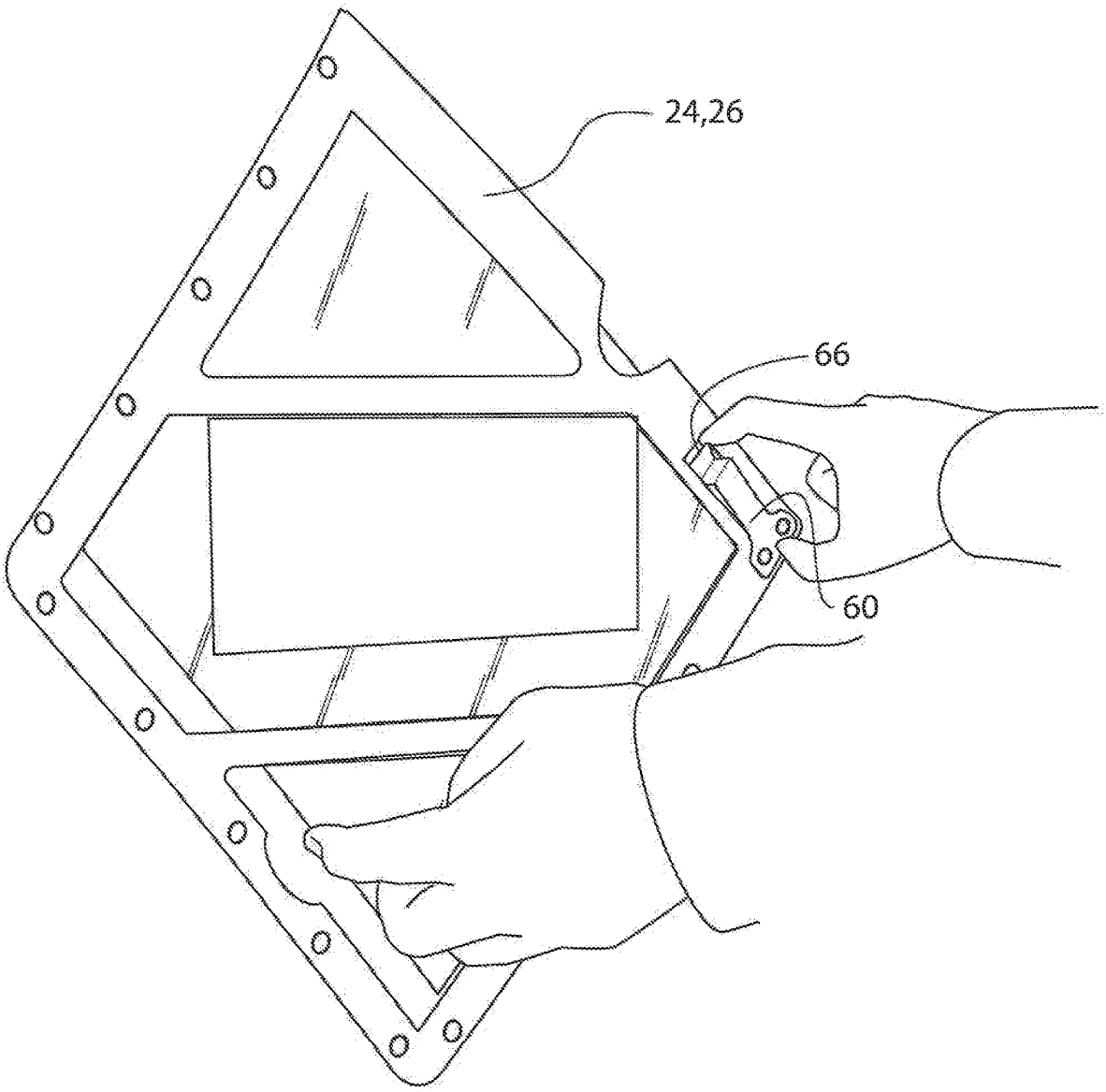
FIG. 9 is a view of a user continuing the process of removing a placard from the flexible placard holder.
Figure 10:
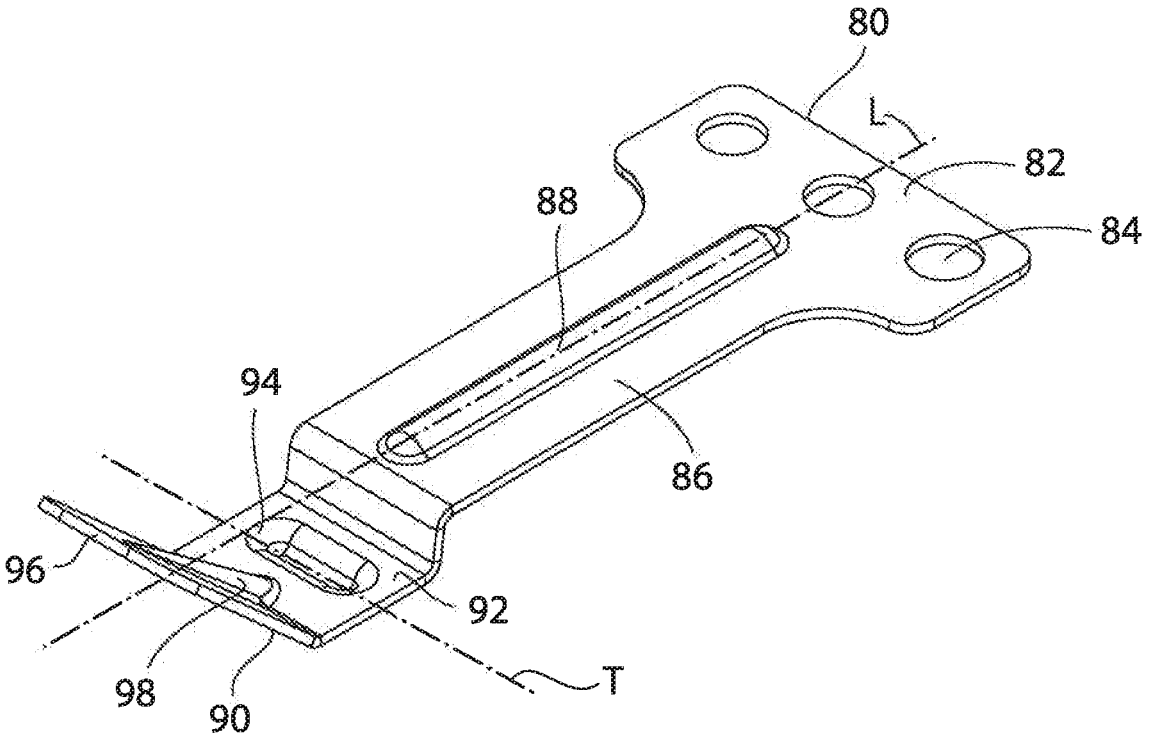
FIG. 10 is a perspective view of an alternate embodiment of a spring clip.
Figure 11:
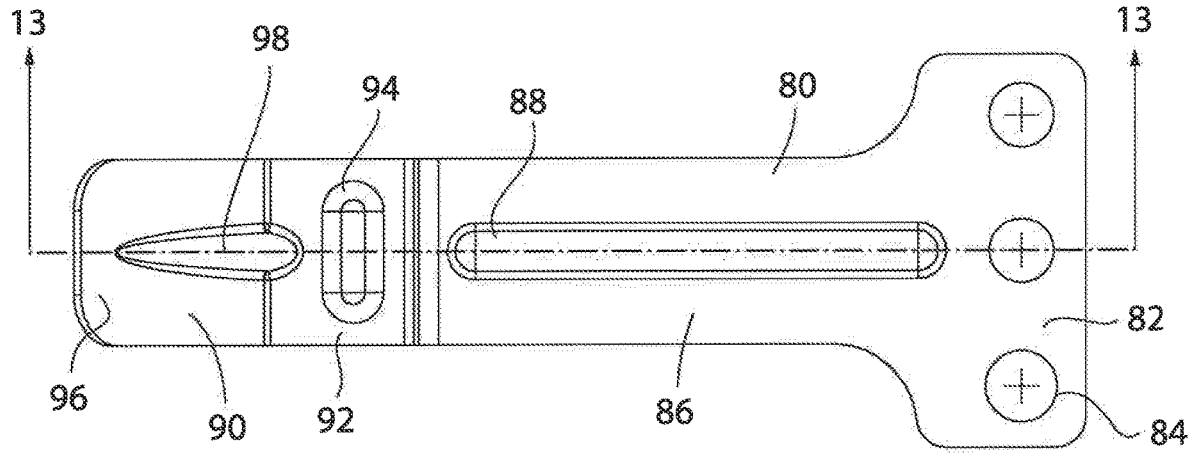
FIG. 11 is a top view of the spring clip of FIG. 10.
Figure 12:
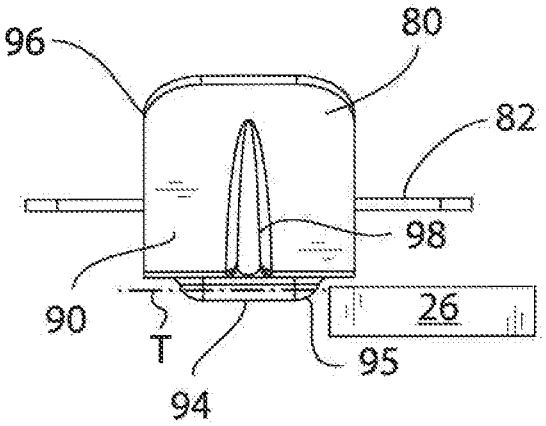
FIG. 12 is an end view of the spring clip of FIG. 10.
Figure 13:
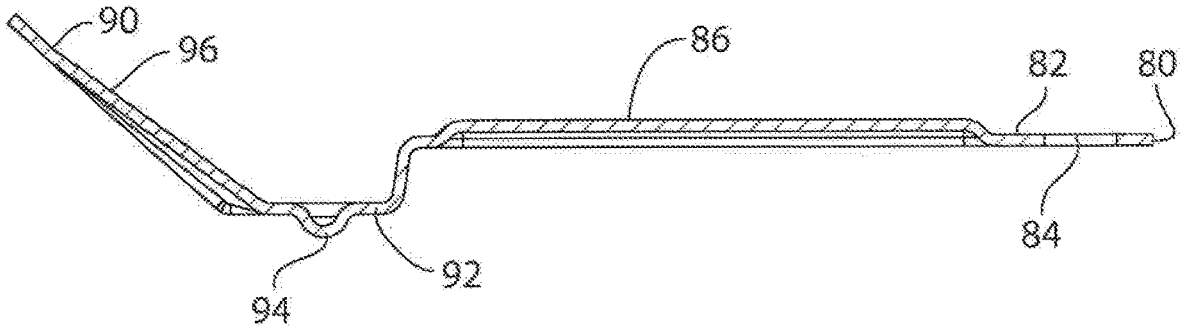
FIG. 13 is a section view taken along line 13-13 of FIG. 10.

As shown in FIG. 8, when the placard 24 and the shield 26 need to be removed or changed, the user inserts a finger into the cutout 46 in the bottom portion 32 of the frame 28. The user's finger can engage one edge of the placard 24 and the shield 26. The cutout 46 acts as a finger access in the holder 20 to aide in sliding the placard 24 and the shield 26 out of the holder 20. As shown in FIG. 9, the user pulls up on the end portion 66 of the clip 60 and slides the placard 24 and the shield 26 along the channel 52 and out of the holder 20. The user then can release the clip 60 to its closed position until another placard and shield are to be inserted.

The user can also release the clip 60 with the placard 24 removed but the shield 26 still in the channel 52. The clip 60 thus holds the shield 26 in place while a user gets another placard. This is especially advantageous in wet or cold weather conditions.

The holder 20 or 70 is flexible and thus can be attached to non-planar surfaces 22 without damaging the holder 20 or 70. The holder 20 or 70 is able to twist or bend which allows it to be attach to flat, curved, conical, elliptical or multi curved surfaces. The holder 20 or 70 enables the frame 28 to be flexible without any additional mechanical features such as upsetting, beads and/or flanges.

The holder 20 or 70 provides much greater ease for the user of inserting and removing a placard and a shield. The one-piece clip 60 biased in a closed position ensures secure placement of the placard 24 and the shield 26 in the holder 20 or 70 thus eliminating two-piece clip complexity and potential failures. The two cutouts 42 and 46 in the frame 28 offer fingertip access to aid in the removal of the placard 24 and the shield 26.

Turning now to FIGS. 10-13, a second embodiment of a spring clip is shown as spring clip 80. Similar to spring clip 60, the spring clip 80 is positioned adjacent the aperture in the frame and secures the placard and the shield in the holder. The clip 80 has a longitudinal axis L and a transverse axis T and includes a base portion 82 mountable to the frame of the holder using apertures 84, includes an elongate arm 86 having thereon a bead 88 and terminates in an end portion 90. The end portion 90 includes a first portion 92 having thereon a bead 94 that is elongate in the direction of axis T. The bead 94 has curved edges 95. The end portion 90 further includes a second portion 96 having thereon a gusset 98. The clip 80 is normally in a biased closed position such that the first portion 92 and specifically the bead 94 are positioned in the aperture of the frame. To remove the first portion 92 of the clip 80 from the aperture, a user lifts up on the second portion 96 manually. When a user releases the second portion 96, the clip 80 returns to its closed position. As such, the user never has to manually move the clip 80 to the closed position. The gusset 98 and the beads 88 and 94 act to stiffen the clip 80. In particular, the bead 94 that is elongate in the direction of axis T strengthens the clip 80 for repeated movement while in use. The curved edges 95 of the bead 94 act as a smooth ramp to slide the shield 26 and/or placard under the clip 80 and act to reduce scratching on the surfaces of the shield 26 and/or placard.

Various features and advantages of the invention are set forth in the following claims.

The invention claimed is:

1. A placard holder for displaying a placard comprising:

a flexible one-piece frame capable of being mounted to a curved surface without being damaged, wherein the frame is defined by a top portion, a bottom portion and two side portions and wherein the frame includes at least one cross brace extending between one of the bottom portion to one of the two side portions and one side portion to the other side portion; and a spacer secured to the frame so as to be adjacent the curved surface and defining a channel for holding a placard.

2. The placard holder of claim 1 and further including a one-piece clip biased in a closed position for holding the placard in the channel.

3. The placard holder of claim 1 and further including a cutout in the bottom portion for visualizing if the placard is correctly positioned in the channel.

4. The placard holder of claim 3 wherein the cutout allows the user access to an edge of the placard.

5. A placard holder for displaying a placard comprising:

a flexible frame capable of being mounted to a curved surface without being damaged, and a spacer secured to the frame defining a channel for holding the placard; wherein the frame is fabricated of aluminum and the spacer is fabricated of plastic.

6. A placard holder for displaying a placard comprising:

a flexible one-piece frame capable of being mounted to a curved surface without being damaged and fabricated of a first material;

a spacer secured to the frame and defining a channel for holding a placard, the spacer fabricated of a second material different from the first material; and a clip for holding the placard in the channel.

7. The placard holder of claim 6 wherein the frame is defined by a top portion, a bottom portion and two side portions.

8. The placard holder of claim 7 wherein the frame further includes at least one cross brace extending from the bottom portion to one of the two side portions.

9. The placard holder of claim 7 and further including a cutout in the bottom portion.

10. The placard holder of claim 6 wherein the clip includes a base portion, an arm portion and an end portion.

11. The placard holder of claim 10 wherein the frame includes an aperture and wherein the end portion of the clip is positioned in the aperture.

12. A placard holder for displaying a placard comprising:

a flexible frame capable of being mounted to a curved surface without being damaged and capable of holding a placard; and a one-piece clip biased in a closed position for holding the placard in the frame, wherein the clip includes a base portion, an arm portion and an end portion, and wherein the clip includes a gusset on the end portion.

13. A placard holder for displaying a placard comprising:

a flexible frame capable of being mounted to a curved surface without being damaged and capable of holding a placard; and a one-piece clip biased in a closed position for holding the placard in the frame;

wherein the clip has a transverse axis and wherein the clip includes at least one bead elongate in the direction of the transverse axis, the bead having a curved surface adapted to act as a ramp.

14. A placard holder for displaying a placard comprising:

a flexible aluminum one-piece frame capable of being mounted to a curved surface without being damaged, the frame defined by a top portion, a bottom portion, two side portions;

a plastic spacer secured to the frame so as to contact the curved surface and defining a channel for holding the placard; and a one-piece clip biased in a closed position for holding the placard in the channel and movable to an open position allowing the placard to be removed from the channel.

15. A placard holder for displaying a placard comprising:

a flexible one-piece frame capable of being mounted to a curved surface without being damaged;

a spacer secured to the frame so as to be adjacent the curved surface and defining a channel for holding a placard; and a one-piece clip biased in a closed position for holding the placard in the channel.

16. A placard holder for displaying a placard comprising:

a flexible one-piece frame capable of being mounted to a curved surface without being damaged, the frame having a bottom portion and the frame including a cutout in the bottom portion adapted to allow a user access to an edge of the placard; and a spacer secured to the frame so as to be adjacent the curved surface and defining a channel for holding a placard.

* * * * *